US012617587B2

(12) United States Patent
Aknin et al.

(10) Patent No.: US 12,617,587 B2
(45) Date of Patent: May 5, 2026

(54) MATERIAL DISPENSING DEVICE

(71) Applicants: SavorEat Ltd., Rehovot (IL); YISSUM RESEARCH DEVELOPMENT COMPANY OF THE HEBREW UNIVERSITY OF JERUSALEM LTD, Jerusalem (IL)

(72) Inventors: Moshe Aknin, Modiin-Maccabim-Reut (IL); Dor Jacobi, Tel Aviv (IL); Yogev Naiim, Tel-Aviv (IL); Oded Shoseyov, Shoham (IL)

(73) Assignees: SAVOREAT LTD., Rehovot (IL); YISSUM RESEARCH DEVELOPMENT COMPANY OF THE HEBREW UNIVERSITY OF JERUSALEM LTD., Jerusalem (IL)

( * ) Notice: Subject to any disclaimer, the term of this patent is extended or adjusted under 35 U.S.C. 154(b) by 188 days.

(21) Appl. No.: 18/550,547

(22) PCT Filed: Mar. 17, 2022

(86) PCT No.: PCT/IL2022/050304
§ 371 (c)(1),
(2) Date: Sep. 14, 2023

(87) PCT Pub. No.: WO2022/195596
PCT Pub. Date: Sep. 22, 2022

(65) Prior Publication Data

US 2024/0190619 A1 Jun. 13, 2024

Related U.S. Application Data

(60) Provisional application No. 63/162,375, filed on Mar. 17, 2021.

(51) Int. Cl.
*B65D 35/28* (2006.01)

(52) U.S. Cl.
CPC ..... *B65D 35/28* (2013.01)

(58) Field of Classification Search
CPC .... B65D 35/25; A23P 2020/253; A23P 20/20; A23P 30/00; B33Y 10/00; B33Y 80/00; B33Y 30/00; G01F 11/082; G01F 11/02
See application file for complete search history.

(56) References Cited

U.S. PATENT DOCUMENTS

| | | | |
|---|---|---|---|
| 5,560,518 | A | 10/1996 | Catterall et al. |
| 6,968,978 | B1 | 11/2005 | Matthews |
| 2002/0092879 | A1 | 7/2002 | Chrisman et al. |
| 2013/0089642 | A1 | 4/2013 | Lipson et al. |
| 2018/0127192 | A1 | 5/2018 | Cohen |

*Primary Examiner* — Vishal Pancholi
(74) *Attorney, Agent, or Firm* — FISHERBROYLES, LLP; Roger L. Browdy; James E. Mrose

(57) ABSTRACT

The technology provides a material dispensing device and a method of dispensing metered amounts of materials from collapsible material containers.

20 Claims, 5 Drawing Sheets

MATERIAL DISPENSING DEVICE

TECHNOLOGICAL FIELD

The invention generally contemplates a material dispensing device for use in dispensing metered material amounts from closed compressible containers.

BACKGROUND OF THE INVENTION

There are numerous devices which have been developed for dispensing materials from collapsible containers. While these devices have been used in industrial and small-scale processes, they were found inefficient in dispensing the full amount contained in the collapsible container and more importantly found inaccurate for delivering metered amounts of materials.

GENERAL DESCRIPTION

The technology developed by the inventors of the invention disclosed herein aims at providing an efficient, easy to use and accurate means for dispensing small, metered amounts of materials from collapsible or compressible containers. The dispensing devices of the invention have been found useful not only in dispensing metered amounts of materials, in amounts ranging from several milliliters or several hundred milliliters, but more specifically in dispensing materials that are typically more difficult to dispense in accurate mounts. Such materials may be viscous materials typically used in the food industry as well as materials which flowability is intimately affected by temperature.

The dispensing unit of the invention is generally configured to dispense materials from horizontally oriented 3-dimensionally structured, at times asymmetric cartridges by utilizing a longitudinally or horizontally movable pressing roller and a vertically movable dispensing rod, operable separate or in sequence, to dispense finely tuned or predetermined amounts of the material from the cartridge. By moving the pressing roller, a predefined distance from its resting position, while applying compression force onto the cartridge or while pressing the cartridge and its content, a predefined material amount may be movable from one volume region of the cartridge to another. Similarly, by downwardly moving the dispensing rod onto the cartridge comprising the amount, at a region above the cartridge outlet, a predefined amount of the material may be dispensed onto a receiving surface positioned below the device.

Thus, devices, systems and methods of the invention are particularly suitable for manufacturing patty-like food products from viscous, fibrous or otherwise thick materials or material compositions.

In a first of its aspects the invention provides a device comprising

- a mounting plate configured to receive (on its surface) a collapsible cartridge containing a material (e.g., the cartridge being positioned parallel to the plate),
- a longitudinally moving cartridge compressing assembly configured and operable for compressing said collapsible cartridge (against the mounting plate), and
- optionally a material dispensing assembly configured and operable to downwardly press said collapsible cartridge, e.g., to dispense a metered amount of a material contained in the cartridge through a material outlet positioned at an opposite face of the cartridge.

The invention further provides a device comprising

- a mounting plate configured to receive (on its surface) a collapsible material-containing cartridge (e.g., that is positioned parallel to the plate),
- a longitudinally moving cartridge compressing assembly configured and operable for compressing said collapsible material-containing cartridge (against the mounting plate), and
- optionally a material dispensing assembly configured and operable to downwardly press said collapsible material-containing cartridge to dispense a metered amount of a material contained in the cartridge through a material outlet positioned at an opposite face of the cartridge.

Also provided is a device comprising

- a mounting plate configured to receive a collapsible material-containing cartridge,
- a longitudinally movable cartridge compressing assembly configured and operable to transit from one position along the mounting plate to another position along the plate and press said cartridge against the mounting plate, thereby causing displacement of a material contained in the cartridge from one region of the cartridge to another, and
- a material dispensing assembly configured and operable to downwardly press said collapsible material-containing cartridge to dispense or to cause dispensing of a metered amount of the material via the at least one material outlet.

In another aspect, there is provided a device (e.g., a dispensing device) for supplying a metered amount of a material from a collapsible cartridge having at least one material outlet, the device comprising

- a mounting plate configured to receive a collapsible material-containing (or non-compressed) cartridge,
- a longitudinally movable cartridge compressing assembly configured and operable for compressing said collapsible material-containing (or non-compressed) cartridge (against the mounting plate), to thereby cause displacement of the material from one region of the cartridge to another, and
- a material dispensing assembly configured and operable to downwardly press said collapsible material-containing (or non-compressed) cartridge to dispense a metered amount of the material via the at least one material outlet.

By another aspect, the invention provides a device configured for horizontal mounting in a material dispensing system, the device comprising

- a mounting plate configured to receive (on its surface) a collapsible cartridge containing a patty material (e.g., the mounting plate is positioned parallel to the plate),
- a longitudinally moving cartridge compressing assembly configured and operable for compressing said collapsible cartridge (against the mounting plate), and
- optionally a material dispensing assembly configured and operable to downwardly press said collapsible cartridge to dispense a metered amount of a material contained in the cartridge through a material outlet positioned at an opposite face of the cartridge.

The device of the invention is configured and operable to dispense a material from a "collapsible material-containing cartridge", namely a cartridge made of a material that allows the cartridge structure to collapse or have its structure modified in response to pressure imposed onto its surface. The material-containing cartridge is a cartridge or a closed container or a closed reservoir which contains an amount of a material. The amount of the material need not take 100% of the cartridge volume. A cartridge containing any dispensable amount of a material and which is made of a cartridge material that is compressible, as defined, is regarded herein as a collapsible material-containing cartridge. Once the material is dispensed from the cartridge, or in case no more of the material can be dispensed from the cartridge, the cartridge is regarded material-free or a compressed cartridge.

A mounting plate is a bed or a floor structure, configured or designed to receive and hold a material-containing cartridge in a way which resists pressure imposed on the cartridge and the underlying mounting plate by the cartridge compressing assembly. In some configurations, the mounting plate is in a form of a rectangular frame having a frame-like base or housing and a flat solid surface of a material and structure capable of supporting and holding the cartridge in place. In some embodiments, the mounting plate is provided with a locking or a clamping mechanism for holding the cartridge in place when the longitudinally moving element moves on the cartridge surface and pressing it against the mounting plate, as disclosed herein.

The mounting plate may alternatively be in the form of an enclosed cage having a flat solid bottom surface, and sides and top capable of limiting expansion of the cartridge upon compression by the longitudinally moving element. The top and side walls of the cage need not be made of a solid surface but may be in a form of a solid net that reduces the tension in the cartridge walls upon compression.

The mounting plate is provided with an opening or a hole that is substantially positioned below and aligned with the material dispensing assembly, the opening having a profile (size and shape) selected to permit fitting of the cartridge outlet therethrough. Each dispensing device according to the invention, provided with a mounting plate, as defined, may be configured to receive a specific type of cartridge defined by an outlet having a size and shape fitting the opening profile provided in the plate.

In some embodiments, the mounting plate is part of the cartridge compressing assembly.

The longitudinally moving cartridge compressing assembly is provided on the surface of the plate and comprises a longitudinally moving element (such as a roller) that is configured to mount and move over the cartridge when positioned in said mounting plate. By applying pressure onto the cartridge and against the mounting plate, the moving element travels at a "contact distance" from the plate, namely at a distance that is between a distance defined by a direct contact with the mounting plate (a distance of zero) and a distance that is substantially equal to a thickness of the material-free (or compressed) cartridge or to a thickness of a region of the cartridge that is free or empty of the material. In other embodiments, the longitudinally moving element may be mounted on one end of said mounting plate and positioned to move over and compress the cartridge so as to displace an amount of the material contained in said cartridge from a first point (or end) to a second point (or end) of said cartridge.

In some other embodiments, the contact distance is a distance that is substantially equal to a thickness of the material-free (or compressed) cartridge or to a thickness of a region of the cartridge that is free or empty of the material.

In other embodiments, the contact distance may be between the thickness of the material-free compressed cartridge and a thickness of the material-containing cartridge that is uncompressed.

The longitudinally moving element may be a roller, a longitudinally moving piston, a pushing surface, or generally a revolving cylinder that is used to press the cartridge. In some embodiments, the moving element is a revolving cylinder that is configured to revolve over (compressing while moving) at least a region of the material-containing cartridge to thereby displace a material from one volume of the cartridge to another, as disclosed herein. In some embodiments, the revolving cylinder is configured to move horizontally over the cartridge at a predetermined distance as disclosed herein. In some additional embodiments, the revolving cylinder is configured to apply a downward pressure on the cartridge surface (or volume) to thereby compress the cartridge and move a volume of a material contained in said cartridge in a forward direction (i.e., in a direction of the revolving cylinder). In some embodiments, the cylinder is an elongated body having a length that is selected to substantially cover the width of the cartridge. In such embodiments, the width of the cartridge is substantially equal to the length of the cylinder. In some embodiments, the cylinder is provided as a set of two or more separately addressable and separately operable cylinders that may be coaxially arranged.

In some embodiments, the moving element is a roller or a rolling assembly comprising one or more rolling elements, each optionally being individually addressable and operable. In some embodiments, the roller is an elongated roller having a length that is selected to substantially cover the width of the cartridge. In other words, in such embodiments, the width of the cartridge is substantially equal to the length of the elongated roller. In some embodiments, the roller is provided as a set of two or more rollers, wherein each is separately addressable and separately operable.

Thus, in another aspect, there is provided a material dispensing device suitable for dispensing a material from an elongated collapsible material-containing (or non-compressed) cartridge having at least one material outlet, the device comprising

- a mounting plate configured to receive the collapsible cartridge,
- a longitudinally movable roller or roller assembly or revolving cylinder, each as defined, configured and operable for moving along the surface of a mounted cartridge and compressing said cartridge against the mounting plate, to cause displacement of the material contained in said cartridge from one region of the cartridge to another, and
- a material dispensing assembly positioned substantially opposite to the at least one material outlet and configured and operable to downwardly press said cartridge to dispense a metered amount of the material via the at least one material outlet.

In some embodiments of a device according to the invention, the longitudinally moving element is mounted on a frame, a rail or positioned in proximity or over the mounting plate.

To avoid slipping of the longitudinally moving element, e.g., roller or a revolving cylinder, when moving on the surface of the cartridge, the longitudinally moving element, e.g., roller, may be provided with a knurled frictional engagement surface providing non-slip advancement over the collapsible material-containing cartridge.

Notwithstanding the angle at which the mounting plate is positioned, e.g., parallel to or at an angle to a main axis of the device of the invention, the longitudinally moving element substantially always moves along a path that is parallel to the plane of the mounting plate. In other words, the longitudinally moving element moves along a path that is the longest axis or main axis of the mounting plate and the mounted cartridge, and also at a contact distance from the mounting plate that remains substantially constant.

In some embodiments, the longitudinally moving element is configured and operable to move at a forward direction, namely in the direction towards the at least one material outlet of the cartridge, over the collapsible material-containing cartridge (non-compressed), thereby compressing the collapsible cartridge and displacing an amount of the material from a first region being further away from the material outlet to a second region of the collapsible cartridge being closer to the material outlet, wherein the distance between the first and second regions being defined by the distance moved by the longitudinally moving element. The longitudinally moving element may be further configured and operable to retract and move at an opposite reverse direction, over the compressed portion of the cartridge, if needed; for example, in order to relieve pressure in the cartridge and stop the flow of material from the outlet.

The first and second regions of the collapsible cartridge may be any two points along a path the longitudinally moving element makes when moving over the collapsible cartridge. The first point may be an end region of a new material-containing cartridge or any point along the path of the longitudinally moving element. The second or any subsequent point may be any other point position that is closer to the material outlet. For example, for displacing an amount of the material in the collapsible material-containing cartridge from one point to another, the longitudinally moving element may move a distance from a first point to a second point that suffices for displacing a specific amount of the material. For displacing the next amount (being same or different from the first amount displaced), the longitudinally moving element may move a distance from the second point (being a first starting point in the displacement of the second amount) to a third point along its path. The distance between any two points along the movement path of the moving element may not be the same. Since the cartridge is not necessarily uniform in cross section, in some embodiments, in order to move same amount of the material, the moving element might need to move different distances according to its location along the path. The longitudinally moving element need not retract back to any of its initial points. The longitudinally moving element will retract in full in case the cartridge needs to be replaced or for any other purpose.

Material displacement from a far end of the cartridge or from a point distant from the cartridge material outlet is required in order to position a sufficient amount of the material at the outlet opening so that a metered amount of the material may be forced or dispensed out through the outlet opening. In most cases, a collapsible material-containing cartridge is provided with at least one material outlet in a form of a nozzle having a discharge orifice for dispensing the material from said cartridge. As stated herein, the outlet may have a profile (shape and size) unique for a particular material content or a particular device.

The material outlet or nozzle may be in a form of an opening on the cartridge front face. In some embodiments, through the opening an adaptor may be inserted. Alternatively, the material outlet may be in a form of an elongated element protruding the outer surface of the cartridge. In some embodiments, the nozzle is or may be adapted with an elongated element, being sufficiently long to extend outwardly from the device of the invention.

The outlet or nozzle diameter may vary according to a plurality of considerations, e.g., according to the way by which the material is deposited. Generally speaking, the nozzle diameter may vary between several millimeters (2-5 mm) to several tens of milliliters (30 mm and more) or several centimeters (1-5 cm) or more. For example, deposition of bulk material would require a larger diameter nozzle e.g., between about 1 and 5 cm diameters, as compared to patterning, which may require a finer and smaller diameter nozzle, e.g., around 6 mm or more.

For the purpose of dispensing a material via the material outlet, it is sufficiently effective to displace an amount of the material in said cartridge using the longitudinally moving element to a region over or in the immediate vicinity the material outlet. Depending, inter alia, on the viscosity of the material, its flowability and its other mechanical properties, the material displaced to a region over or in the vicinity of the material outlet can gravitationally collect in the outlet and dispense therefrom. However, for certain types of materials exhibiting, e.g., higher viscosities, devices of the invention may be further equipped with an independently operated material dispensing assembly that may be positioned at an angle (e.g., perpendicularly) to the mounting plate and at a position substantially aligned with the material outlet, the nozzle of said cartridge. Once an amount of the material is displaced in the cartridge at the direction of the material outlet, as disclosed herein, and once a sufficient amount of the material is provided at the outlet opening, a pressing rod provided in said dispensing assembly may be lowered in a direction of the cartridge and presses the cartridge over the material outlet to thereby force a metered amount of the material through the outlet. In addition to the pressing rod, the material dispending assembly may further comprise a forward and a backward drive motor that is coupled to said pressing rod such that when the drive motor is actuated to a forward direction the rod moves in a forward direction pressing the collapsible material-containing cartridge just enough to compress the collapsible cartridge and displace an amount of the material through the nozzle. When the motor is actuated to a reverse direction the rod retracts in a direction away from the cartridge and a further amount of the material is not dispensed. By careful operation of the drive motor, compression of the cartridge by the rod allows dispensing of predefined amounts of the material.

The disclosure further provides a device for supplying a metered amount of a material from a collapsible cartridge having at least one material outlet, the device comprising

- a cartridge compressing assembly comprising,
  - a mounting plate configured to receive a collapsible material-containing (or non-compressed) cartridge;
  - a longitudinally moving element mounted over said plate at a distance being substantially equal to a thickness of a material-free (or compressed) cartridge;
  - a forward and a backward drive motor coupled to said longitudinally moving element such that when the drive motor is actuated to a forward direction the longitudinally moving element moves in a forward direction over the collapsible material-containing cartridge, thereby compressing the collapsible cartridge and displacing the material from a first region within the collapsible cartridge to a second region within the collapsible cartridge, wherein the distance between the first and second regions being defined by a distance moved by the longitudinally moving element, and when the motor is actuated to a reverse direction the roller retracts in a direction over the compressed portion of the cartridge;
- a material dispensing assembly positioned at an angle to said mounting plate (typically perpendicular to said plate) and at a position aligned with a material outlet, e.g., a nozzle, of said cartridge (the nozzle having a discharge orifice for dispensing the material from said cartridge), the dispensing assembly comprising a pressing rod;

a forward and a backward drive motor coupled to said pressing rod such that the drive motor is actuated to a forward direction the rod moves in a downward direction pressing the collapsible material-containing cartridge, thereby compressing the collapsible cartridge and dispensing an amount of the material through the outlet, or nozzle, and when the motor is actuated to a reverse direction the rod retracts in a direction away from the cartridge.

In order to maintain or increase stability of the materials in the cartridge, the cartridge may be refrigerated (e.g., maintained at refrigeration conditions comprising a temperature between −5 and 18° C.). Cooling may be achieved by any means known in the art and to any temperature that may be desired. In some embodiments, only the cartridge is cooled while positioned in the device; while in other embodiments, the cartridge is positioned within a refrigeration bay, maintaining the device as a whole at a desired preset temperature. As cooling may increase the viscosity of the material inside the cartridge, in some cases, immediately before use, the temperature may be increased to momentarily reduce the viscosity of the material and enable case of delivery.

In some embodiments, the dispensing device of the invention is a refrigerated device or provided within a refrigeration bay or enclosure or a closed frame or a contained environment, thereby maintaining the device at a predefined temperature; wherein the temperature may be determined based, inter alia, the materials stability, the material flowability (in which case the temperature may be increased or decreased to keep the materials at a desired viscosity), etc.

Dispensing devices according to the invention are typically positioned over a movable recipient surface selected to receive a metered amount of the material from the device nozzle. Where several materials are to be received by the recipient surface, multiple units of the device may be positioned and operated to discharge metered amounts of each of the materials contained in their respective cartridges. Thus, a system may be provided which comprises one or more device units or dispensing units as disclosed herein, optionally arranged in an array of units, each configured and operable to dispense a different (or same) material from a device cartridge. Each of the one or more devices in a system may be positioned with respect to a same or different receipt surface onto which a material may be dispensed. In some embodiments, each or a number of the one or more devices are provided with their respective individual recipient surfaces; in other embodiments, each of the one or more devices is positioned with respect of a single or same receipt surface so as to manufacture a multi-material product. Where a single recipient surface is provided, one of or both of the receipt surface and the one or more devices are movable in relation to the other to enable material deposition from the one or more devices onto the recipient surface. In some configurations, the dispensing unit or refrigeration bay comprising one or more of such units are fixed in their position (namely do not move) and the one or more recipient surfaces is/are movable in a direction selected to receive an amount of a material from a cartridge outlet, or from a plurality of materials from a plurality of cartridges, and further optionally move into or towards or in a direction of a cooking element or cooking region where the material(s) received on the surface are cooked or thermally treated. In other words, in such configurations, the dispensing unit(s) may be fixed elements and the one or more recipient surfaces have the degrees of freedom to move in all directions with respect to the dispensing unit or cartridge outlet.

The recipient surface may be a cooking surface, a movable tray, a mold, a disposable cooking mold and others. In some embodiments, the recipient surface is configured to translocate a dispensed amount of the material from the dispensing unit into a mixing unit or the cooking region.

In some embodiments, the recipient surface may be configured to shape the material received thereon into a final shaped and sized product. Thus, in some embodiments, the recipient surface may be a shaping tool in a form of e.g., a mold, or a structured frame, or a pie iron, or a pressing and shaping tool, etc.

The invention further provides at least one system comprising one or more individually addressable and individually operated dispensing devices according to the invention, one or more recipient surfaces for receiving a metered amount of a material from said one or more dispensing devices, and optionally one or more product cooking units.

In some embodiments, the system comprises two or more individually addressable and individually operated dispensing devices according to the invention, one or more recipient surfaces for receiving a metered amount of a material from each one of said two or more dispensing devices, and optionally one or more product cooking units.

In some embodiments, each of the dispensing devices is mounted to occupy a single surface. In some embodiments, each of the dispensing devices is positioned horizontally in the system, such that the cartridges are similarly positioned horizontally in their respective dispensing devices.

In some embodiments, each of the dispensing units is individually addressable and each of the cartridges provided in each dispensing unit is individually addressable.

In some embodiments, the system comprises at least one dispensing device of the invention, wherein each of the at least one dispensing device comprises at least one cartridge.

In some embodiments, the system comprises one or more individually addressable dispensing devices, each device comprises:

a mounting plate configured to receive (on its surface) a collapsible material-containing cartridge (e.g., that is positioned parallel to the plate), a longitudinally moving cartridge compressing assembly configured and operable for compressing said collapsible material-containing cartridge (against the mounting plate), and optionally a material dispensing assembly configured and operable to downwardly press said collapsible material-containing cartridge to dispense a metered amount of a material contained in the cartridge through a material outlet positioned at an opposite face of the cartridge.

Any of the embodiments disclosed herein with reference to a dispensing device, are applicable to a system and a method of the invention.

In some embodiments, the system comprises a cutting tool configured and operable to release a metered amount of the material from the cartridge outlet or nozzle. The cutting tool may be provided below the cartridge outlet and independent of the configuration of the dispensing device and/or cartridge.

In some embodiments, the cutting tool is a movable cutting surface or an extended movable wire, thread or rod that are each movable below the outlet or nozzle in a direction substantially perpendicular to the flow path of the material from the cartridge outlet.

In some embodiments, each of the one or more individually addressable and individually operated dispensing unit is configured to receive a cartridge that is individually identifiable by a tag, e.g., by RFID tag, reporting particulars such as net volume or net weight, material content, amount of material used or remaining, material manufacturing date, material expiration date, cartridge expiration date, etc.

In some embodiments, the system is a 3D object manufacturing system, wherein the 3D object is manufactured of one or more materials. The object may be a food object and the system may thus be a 3D food printing system. In such configurations, each of the cartridges comprises a food material selected for example amongst food components, and additives. Such may be selected vitamins, fats, proteins, pro-biotics, carbohydrates, amino acids, cellulosic materials, fibers, water, oils, flavoring agents, coloring agents, stabilizers, antioxidants, and others.

Each dispensing device provided in a system of the invention may be individually addressable and individually operated to dispense a different material, a different amount of the material, dispense a material together or before or after or in an alternating fashion with another same or different material dispensed from a different device.

In some embodiments, the system is a 3D printing or manufacturing unit or a digital printing unit. In some embodiments, the system further comprises a material mixing unit, a product assembly unit and a product cooking unit.

In some embodiments, one or more of the devices provided in a system of the invention may be configured to dispense a material or a combination of materials into one or more containers or receptacles or mixing containers configured and operable to receive the material(s) and formulate it, e.g., by mixing or at a preset temperature, into a material combination. The material combination may be a mixture of the materials dispensed from the cartridges or may be a chemical form resulting from a reaction or an interaction between the materials. Irrespective of the form of the material combination, each mixing container may be equipped with a mixing unit, a heating unit, a cooling unit or any other unit that converts the materials into a desired form. Typically, a system of the invention may comprise two or more mixing containers, each positioned with respect to the devices in a way permitting direct or indirect transfer of metered amounts of materials from the cartridges into the mixing containers and the printing head.

The print head (outlet) present in a system of the invention is configured to discharge any one or more material or a combination of materials via one or more nozzles. The nozzles may be provided with an end receiving the materials or combination thereof from said cartridges or mixing containers and an outlet end through which the material or combinations thereof is discharged onto the recipient surface. The outlet end may be provided with a planar extension that extends an outer circumference of the nozzle outlet. The planar extension is provided for maintaining an object thickness defined by the distance between the recipient surface and the planar extension.

A system of the invention may be further provided with a control system configured to coordinate and execute necessary instructions to create the product chosen by a user. It may control motors, sensors and transducers and get information back from each. All device or system mechanisms are monitored for position by encoders which allow closed loop control. The production or material dispensing sequences and the metering of quantity amounts of materials from the cartridges are controlled by a file/recipe and in most cases, include synchronized control in regard to the positioning system of the recipient surface, e.g., built tray.

In some embodiments, each of the cartridges is individually identifiable by a tag, e.g., by RFID tag, reporting particulars such as net volume or net weight, material content, amount of material used or remaining, material manufacturing date, material expiration date, cartridge expiration date, etc.

Further provided is a method for supplying a metered amount of a material from a collapsible cartridge having at least one material outlet, the method comprising in a device comprising a mounting plate provided with a collapsible material-containing (or non-compressed) cartridge, compressing said collapsible material-containing (or non-compressed) cartridge to displace a material in said cartridge to a region of the cartridge provided with a cartridge outlet, and downwardly pressing on the material above the cartridge outlet to cause dispensing of a metered amount of the material via the outlet.

In another aspect there is provided a method of forming a food product, e.g., a patty like food product, the method comprising: in a device comprising a mounting plate provided with a collapsible material-containing (or non-compressed) cartridge having a material outlet, compressing said collapsible material-containing (or non-compressed) cartridge to displace a material in said cartridge to a region of the material outlet, and downwardly pressing on the material above the material outlet to cause dispensing of a metered amount of the material via the outlet.

The invention further provides a continuous process for producing one or more food products, the process comprising:

in a device comprising a mounting plate provided with a collapsible material-containing (or non-compressed) cartridge having a material outlet, (a) compressing said collapsible material-containing (or non-compressed) cartridge to displace a material in said cartridge to a region of the material outlet, and (b) downwardly pressing on the material above the cartridge outlet to cause dispensing of a metered amount of the material via the outlet onto a receiving surface positioned at the outlet opening; and repeating steps (a) and (b) one or more times to thereby produce the one or more food products.

In some embodiments of methods of the invention, the compressing comprises use of a longitudinally movable cartridge compressing assembly configured and operable to transit from one position along the mounting plate to another position along the plate and press said cartridge against the mounting plate.

In some embodiments of methods of the invention, the pressing comprises use of a material dispensing assembly configured and operable to downwardly press the cartridge to dispense a metered amount of the material via the outlet.

In some embodiments of methods of the invention, the method comprises dispensing and discarding a first amount of the material from a cartridge. In some embodiments, the first amount of the material is a first amount dispensed from a fresh newly used cartridge. In some embodiments, the first amount of the material is a first amount dispensed after the device has been inoperable for a period of time.

Also provided is a cartridge unit in a form of a closed container formed of a flexible material and equipped with at least one outlet, the cartridge containing at least one material and adapted for use in a device according to the invention.

BRIEF DESCRIPTION OF THE DRAWINGS

In order to better understand the subject matter that is disclosed herein and to exemplify how it may be carried out in practice, embodiments will now be described, by way of non-limiting example only, with reference to the accompanying drawings, in which.

DETAILED DESCRIPTION OF EMBODIMENTS

Figures referenced herein demonstrate certain non-limiting embodiments of the invention disclosed herein.

Figure 1:
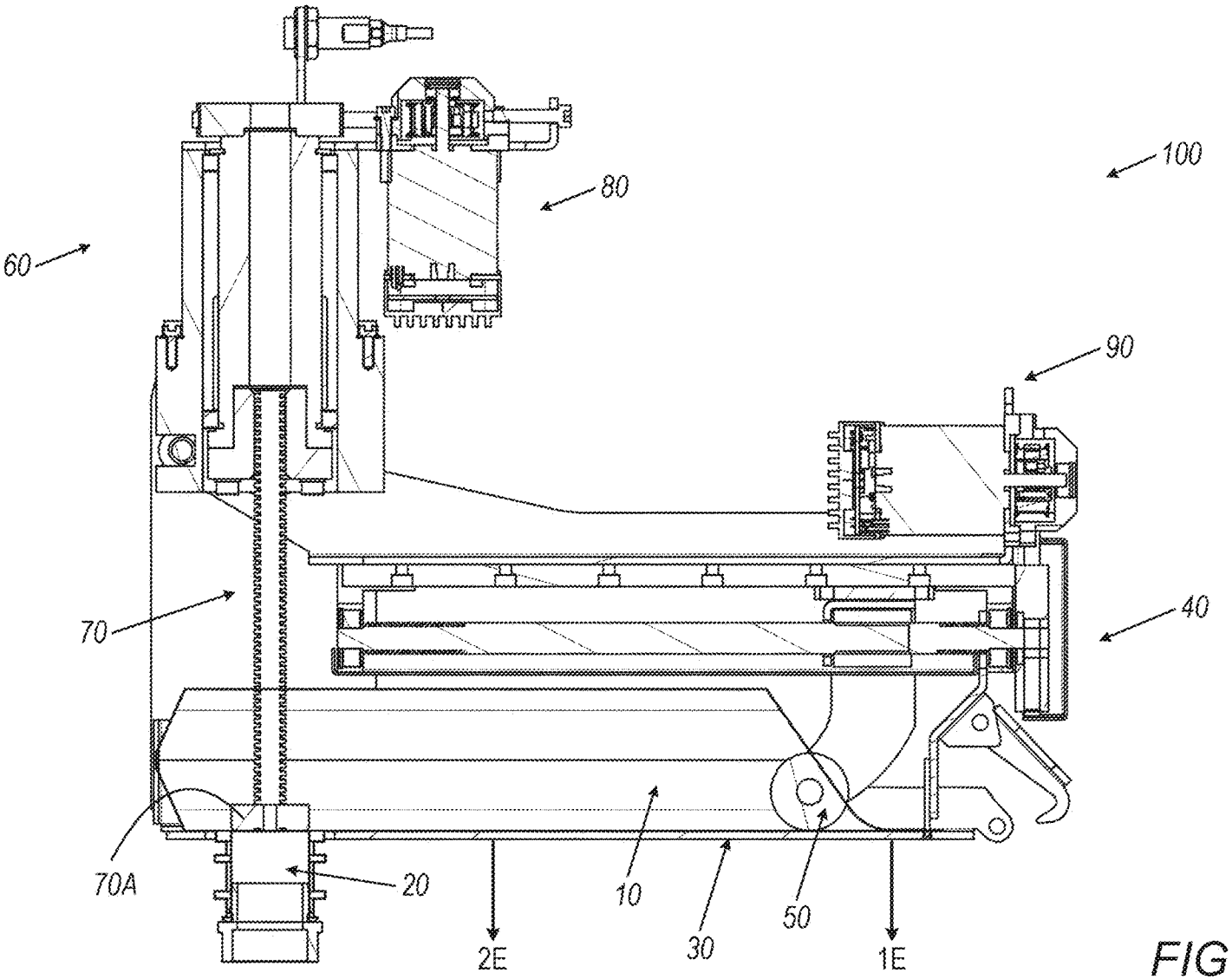
FIG. 1 depicts a side view of a dispensing unit according to some embodiments of the invention.
Figure 2:
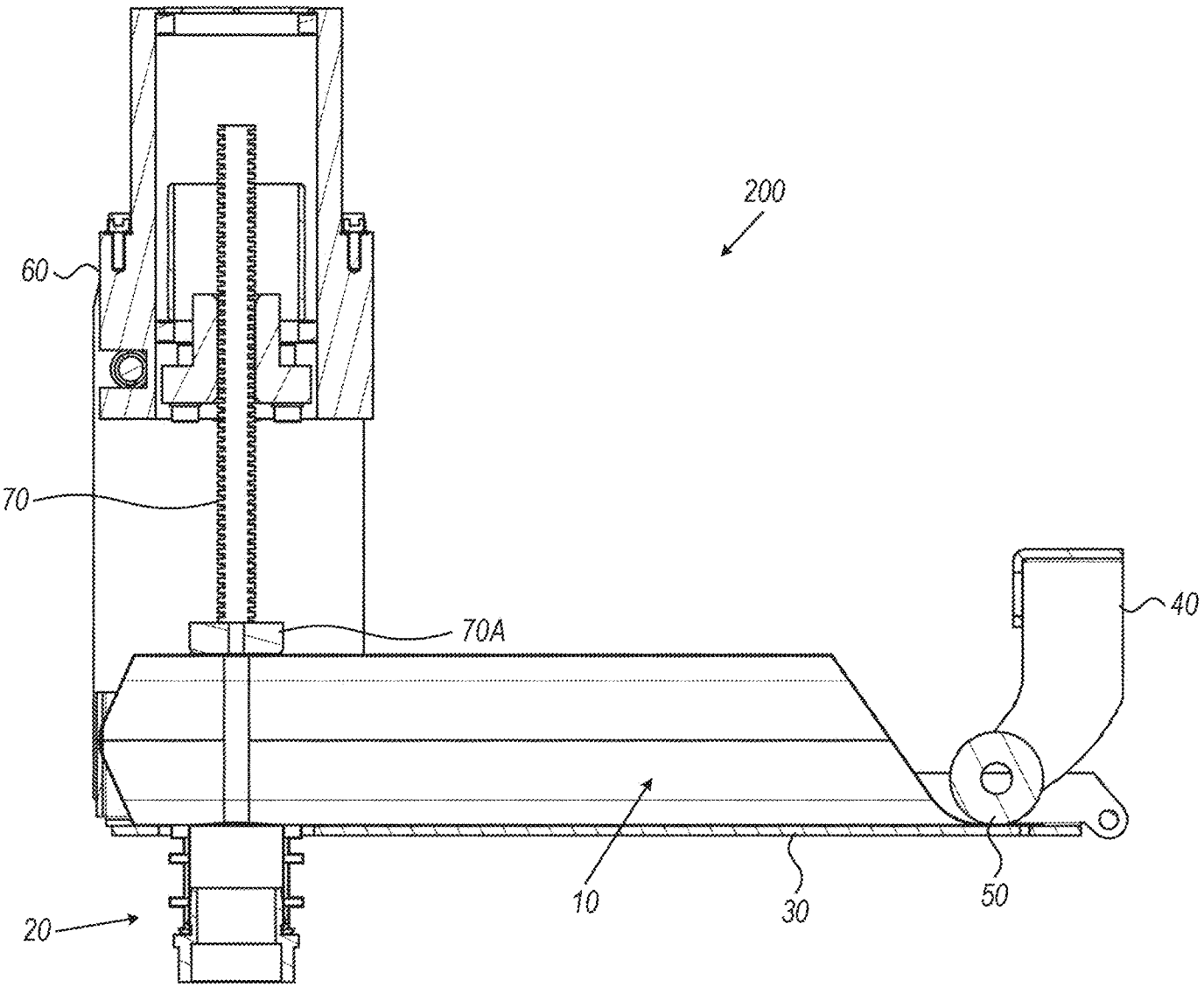
FIG. 2 depicts another simplified view of a unit according to the invention, wherein the pressing rod is in a raised position.

FIG. 1 demonstrates a cross section of a device 100 (e.g., a dispensing device) for supplying a metered amount of a material from a collapsible cartridge 10 having at least one material outlet 20, the device comprising a mounting plate 30 that is substantially horizontal, namely not tilted to any degree, and configured to receive a collapsible material-containing (or non-compressed) cartridge 10, a cartridge compressing assembly 40, comprising a roller or a revolving cylinder 50, configured and operable for pressing the collapsible material-containing (or non-compressed) cartridge 10 against the mounting plate 30, thereby compressing the cartridge and causing displacement of the material within the cartridge from one region of the cartridge to another, and a material dispensing assembly 60 configured and operable to press, e.g., via a pressing rod 70, said collapsible material-containing (or non-compressed) cartridge 10 to thereby dispense a metered amount of the material via the at least one material outlet 20. In some embodiments, the pressing rod may be provided with a pressing extension 70A that may be in the form of a solid extension base or surface (extending the circumference of the pressing rod), which may be lowered onto the surface of the cartridge 10 immediately above the material outlet 20. In this figure, the pressing extension is shown in its lowest position along the pressing rod. In FIG. 2, showing a simplified view of a device 200 of the same configuration as device 100 of FIG. 1, the pressing surface 70A is shown at a position higher than the circumference of the cartridge at one of several so-called rest positions of the pressing rod.

FIG. 1 further shows a motor assembly 80 for operating the material dispensing assembly 60 and a motor assembly 90 for operating the cartridge compressing assembly 40.

Figure 3:
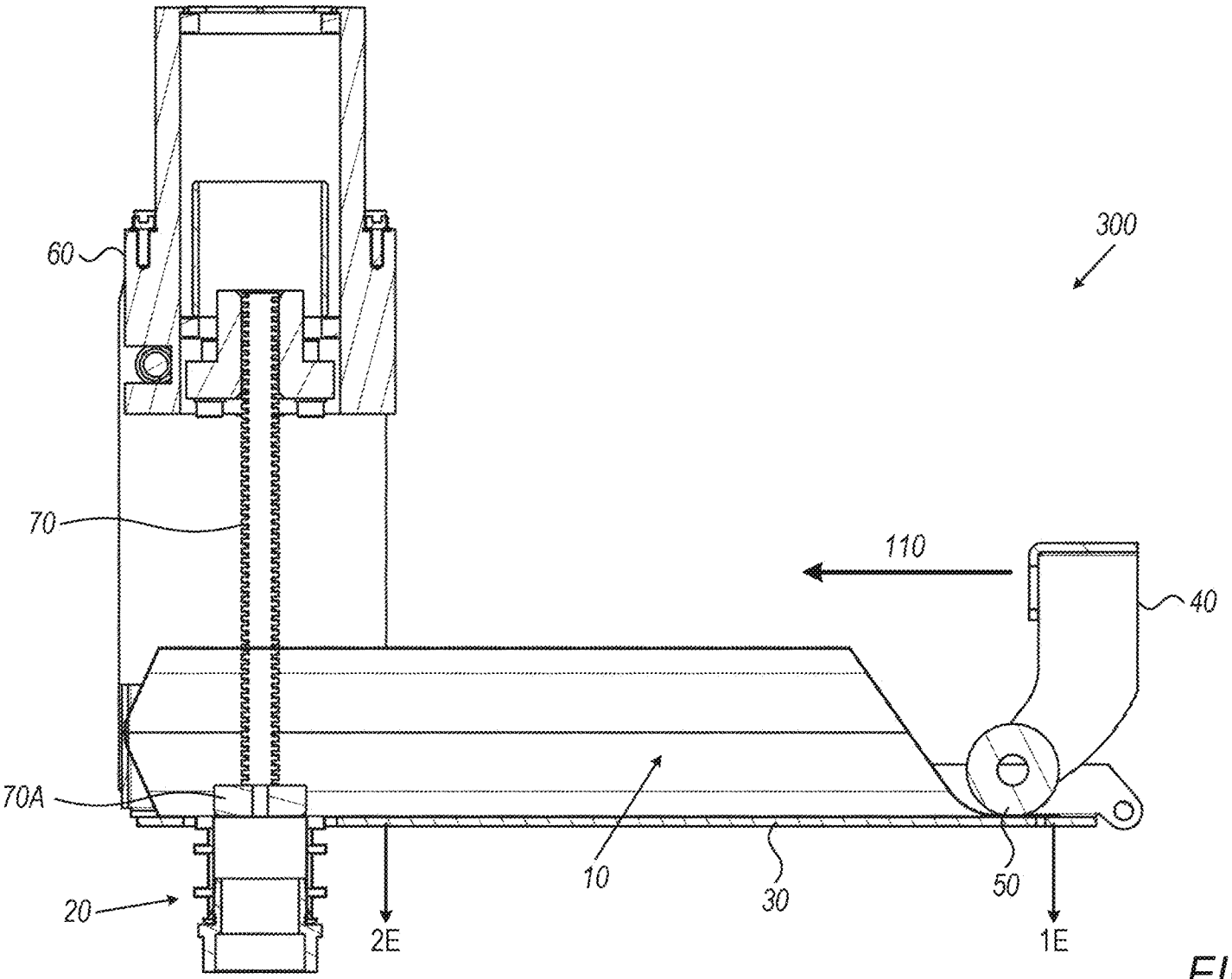
FIG. 3 depicts another simplified view of a unit according to the invention, wherein the pressing rod is in a lowered position.

FIG. 3 shows a simplified sectional view of device 300 (being equivalent to device 100 and device 200), wherein the cartridge compressing assembly 40 (partially shown) comprises a longitudinally moving element 50 in a form of a roller or a revolving cylinder, mounted over said mounting plate 30 and being at a "contact distance" from said plate. As shown, the longitudinally moving element 50 may be mounted on one end 1E of said mounting plate 30 and positioned to move over the surface of the cartridge 10 towards a second end 2E (an exemplary point along the path of the moving element) of said mounting plate 30, in the direction 110 shown. When moving from 1E to 2E, element 50 compresses the cartridge 10 and displaces a material from point 1E to 2E. After a material amount has been so displaced, the pressing rod 70 may be lowered to dispense a metered amount of the material through nozzle 20. In the depicted figure, the rod 70 is shown in its most downward position, irrespective of the cartridge (compression of the cartridge is not depicted for reasons of clarity).

Figure 4:
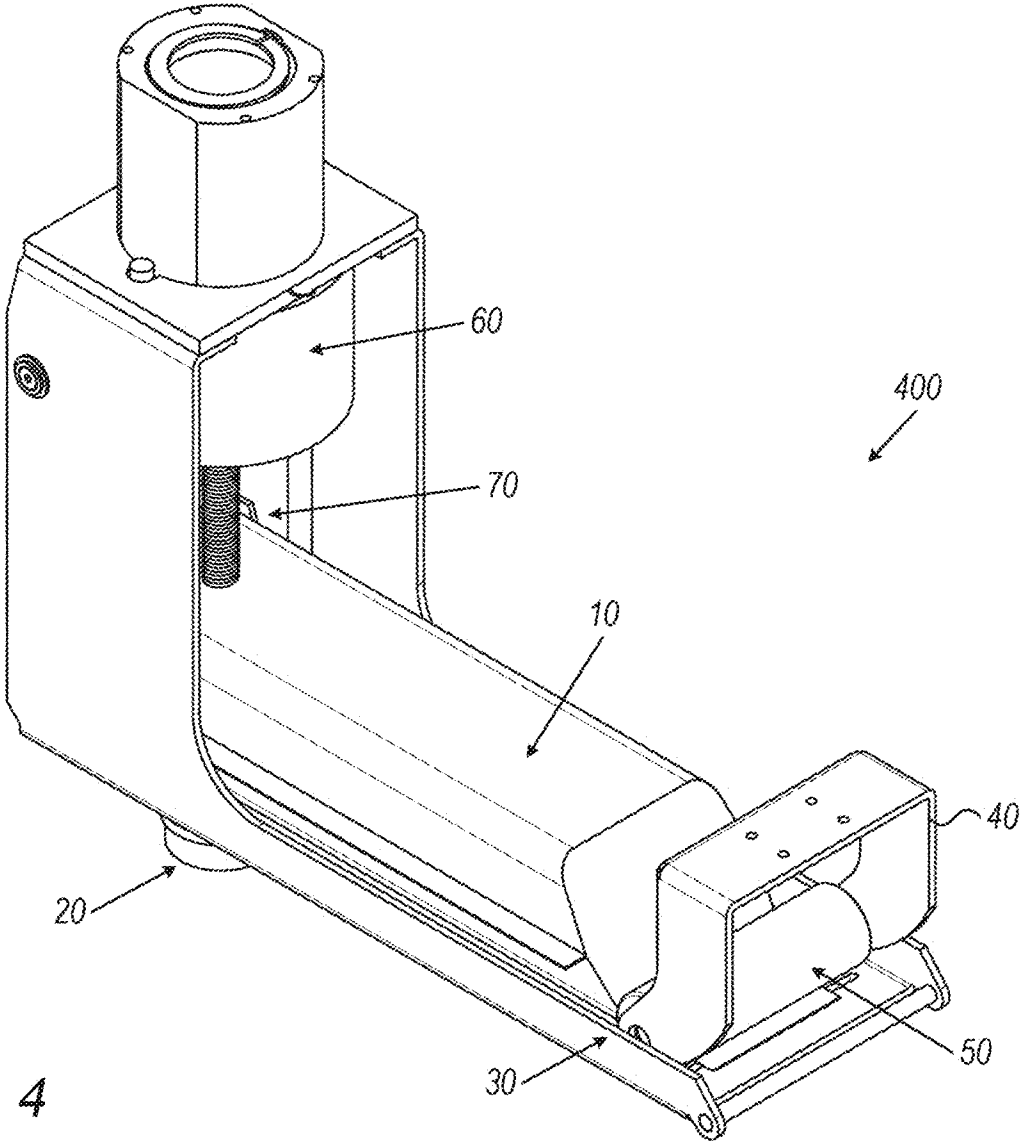
FIG. 4 depicts another simplified side view of a unit according to the invention.

FIG. 4 shows a simplified overview of device 400, showing the various elements depicted in FIGS. 1, 2 and 3.

Figure 5:
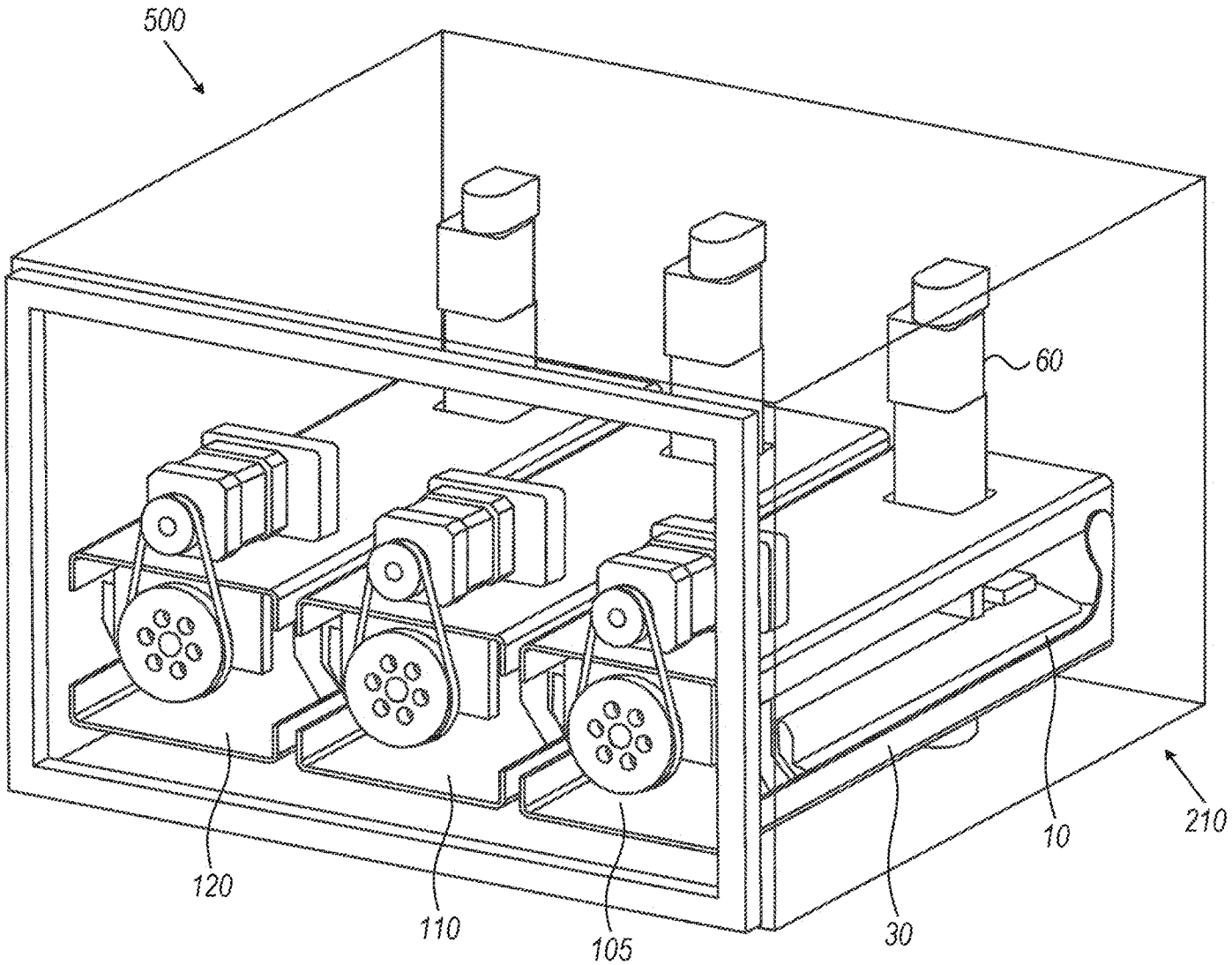
FIG. 5 depicts a refrigeration bay comprising three dispensing units of the invention.

FIG. 5 depicts a refrigeration bay 500 according to some embodiments of the invention. As depicted, the bay comprises an enclosure 210 which houses three dispensing units, 105, 110 and 120, each unit being generally as depicted herein, having each a cartridge 10 positioned on a mounting plate 30. The depiction of three units within the bay is for exemplification purposes only. Other bays may include 1, 2, 3, 4, 5, 6, 7, 8, 9, 10 or more dispensing units. In some embodiments, the number of units in a bay is between 2 and 6 or between 2 and 10. In some embodiments, the number of units in a bay is between 3 and 6.

In some embodiments, each system of the invention may comprise 1 or more refrigeration bays, wherein each may comprise between 2 and 10 dispensing units.

In all figures provided herein, the mounting plate 30 shown represents a single embodiment of the invention. In alternative embodiments, the mounting plate 30 may be in the form of an enclosed cage having a flat solid bottom surface on which the cartridge lays and sides and a top capable of limiting expansion of the cartridge upon compression by the longitudinally moving element 50. The top and side walls of the cage (not shown in the figures) need not be made of a solid surface but may be in form a solid net that reduces the tension in the cartridge walls upon compression.

The invention provides a device as embodied in the figures herein, the device comprising

- a cartridge compressing assembly (FIG. 1, 40) comprising,
  - a mounting plate (FIG. 1, 30) configured to receive a collapsible material-containing (or non-compressed) cartridge (FIG. 1, 10);
  - a longitudinally moving element (FIG. 1, 50) mounted over said plate at a distance being substantially equal to a thickness of a material-free (or compressed) cartridge;
  - a forward and a backward drive motor (FIG. 1, 90) coupled to said longitudinally moving element (FIG. 1, 50) such that when the drive motor is actuated to a forward direction the longitudinally moving element moves in a forward direction over the collapsible material-containing cartridge, thereby compressing the collapsible cartridge and displacing the material from a first region (FIG. 1, 1E) of the collapsible cartridge to a second region (FIG. 1, 2E) of the collapsible cartridge, wherein the distance between the first and second regions being defined by a distance moved by the longitudinally moving element, and when the motor is actuated to a reverse direction the roller retracts in a direction over the compressed portion of the cartridge;
- a material dispensing assembly (FIG. 1, 60) positioned at an angle to said mounting plate and at a position aligned with a material outlet, e.g., a nozzle (FIG. 1, 20), of said cartridge (the nozzle having a discharge orifice for dispensing the material from said cartridge, not shown), the dispensing assembly comprising a pressing rod (FIGS. 1, 70 and 70A);

a forward and a backward drive motor (FIG. 1, 80) coupled to said pressing rod such that the drive motor is actuated to a forward direction the rod moves in a forward direction pressing the collapsible material-containing cartridge, thereby compressing the collapsible cartridge and displacing an amount of the material through the nozzle means, and when the motor is actuated to a reverse direction the rod retracts in a direction away from the cartridge.

The invention claimed is:

1. A material dispensing device comprising:

a horizontal mounting plate configured to receive on its surface a collapsible cartridge containing a material, a longitudinally moving cartridge compressing assembly configured and operable for compressing said collapsible cartridge against the mounting plate, the longitudinally moving cartridge compressing assembly comprising:

a longitudinally moving roller or revolving cylinder mounted over Raid mounting plate at a distance being substantially equal to a thickness of a material-free cartridge;

a first forward and a backward drive motor coupled to said longitudinally moving roller or revolving cylinder such that when the drive motor is actuated to a forward direction the longitudinally moving roller or revolving cylinder moves in a forward direction over the collapsible material-containing cartridge, thereby compressing the collapsible cartridge and displacing the material from a first region within the collapsible cartridge to a second region within the collapsible cartridge, wherein the distance between the first and second regions is defined by a distance moved by the longitudinally moving roller of revolving cylinder, and when the motor is actuated to a reverse direction the longitudinally moving roller or revolving cylinder retracts in a direction over the compressed portion of the cartridge, and a material dispensing assembly configured and operable to downwardly press said collapsible cartridge, to thereby dispense a metered amount of a material contained in the cartridge through a material outlet, the material dispensing assembly positioned at an angle to said mounting plate and at a position aligned with a material outlet of said cartridge, the material dispensing assembly comprising a pressing rod;

a second forward and a backward drive motor coupled to said pressing rod such that the drive motor is actuated to a forward direction the rod moves in a downward direction pressing the collapsible material-containing cartridge, thereby compressing the collapsible cartridge and dispensing an amount of the material through the material outlet, and when the motor is actuated to a reverse direction the rod retracts in a direction away from the cartridge.

2. The device according to claim 1, wherein the material outlet is positioned at an opposite face of the cartridge relative to a surface of the cartridge on which the dispensing assembly presses.

3. The device according to claim 1, wherein the longitudinally moving roller or revolving cylinder is mounted over said mounting plate at a contact distance from said mounting plate.

4. The device according to claim 1, wherein the longitudinally moving roller or revolving cylinder is mounted on one end of said mounting plate and positioned to compress the material-filled cartridge towards a second end of said mounting plate.

5. The device according to claim 1, wherein the first region is further away from the material outlet and the second region of the collapsible cartridge is closer to the material outlet.

6. The device according to claim 1, being a refrigerated device.

7. A system comprising one or more material dispensing devices, each material dispensing device comprising a horizontal mounting plate configured to receive on its surface a collapsible cartridge containing a material, a longitudinally moving cartridge compressing assembly configured and operable for compressing said collapsible cartridge against the mounting plate, and a material dispensing assembly configured and operable to downwardly press said collapsible cartridge, to thereby dispense a metered amount of a material contained in the cartridge through a material outlet, and further comprising a cutting tool configured and operable to release a metered amount of the material from each respective cartridge outlet.

8. The system according to claim 7, wherein each of said one or more devices is individually addressable or individually operated to dispense a different material, a different amount of the material, dispense a material together or before or after or in an alternating fashion with another same or different material dispensed from a different device.

9. The system according to claim 7, being a 3D printing or manufacturing unit or a digital printing unit.

10. The system according to 7, further comprising a material mixing unit, a product assembly unit and a product cooking unit.

11. The system according to claim 7, wherein the cutting tool is a movable cutting surface or an extended movable wire, thread or rod movable below the outlet in a direction substantially perpendicular to the flow path of the material from the cartridge outlet.

12. A method of forming a food product, the method comprising: in a system comprising a plurality of devices, each device comprising a mounting plate provided with a collapsible material-containing cartridge having a material outlet and further comprising a movable recipient surface configured to receive a metered amount of the material from the material outlet of each dispensing device, dispensing material from a first device onto the recipient surface by compressing the collapsible material-containing cartridge in said first device to displace a material in said cartridge to a region of the material outlet, and downwardly pressing on the material above the material outlet to cause dispensing of a metered amount of the material via the outlet;

moving the recipient surface from beneath an outlet of the first device to an outlet of a second device, and dispensing a metered amount of material from the second device; and repeating the foregoing steps until all desired ingredients of the food product from the devices are dispensed onto the recipient surface.

13. The system according to claim 7, further comprising a movable recipient surface configured to be moved to beneath receive a metered amount of the material from the material outlet of each dispensing device.

14. The system according to claim 7, wherein, in each material dispensing device, the material outlet is positioned at an opposite face of the cartridge relative to a surface of the cartridge on which the dispensing assembly presses.

15. The system according to claim 7, wherein, in each material dispensing device, the cartridge compressing assembly comprises a longitudinally moving element mounted over said mounting plate and being at a contact distance from said mounting plate.

16. The system according to claim 15, wherein the contact distance is a distance that is substantially equal to a thickness of the material-free cartridge or to a thickness of a region of the cartridge that is free or empty of the material.

17. The system according to claim 7, wherein, in each material dispensing device, the longitudinally moving element is mounted on one end of said mounting plate and positioned to compress the material-filled cartridge towards a second end of said mounting plate.

18. The system according to claim 7, wherein, in each material dispensing device, the longitudinally moving element is a roller, a longitudinally moving piston, or a pushing surface, or a revolving cylinder.

19. The system according to claim 7, wherein, in each material dispensing device, the longitudinally moving element is configured and operable to move at a forward direction, over the collapsible material-containing cartridge, thereby compressing the collapsible cartridge and displacing an amount of the material from a first region being further away from the material outlet to a second region of the collapsible cartridge being closer to the material outlet.

20. The system according to claim 19, wherein the longitudinally moving element is configured and operable to retract and move at the opposite reverse direction, over the compressed portion of the cartridge.

* * * * *